US006369376B1

(12) United States Patent
Gerlach

(10) Patent No.: US 6,369,376 B1
(45) Date of Patent: Apr. 9, 2002

(54) CONVEYOR DEVICE

(75) Inventor: Karl-Heinz Gerlach, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/462,602

(22) PCT Filed: Jun. 26, 1998

(86) PCT No.: PCT/DE98/01773

§ 371 Date: Mar. 30, 2000

§ 102(e) Date: Mar. 30, 2000

(87) PCT Pub. No.: WO99/02788

PCT Pub. Date: Jan. 21, 1999

(30) Foreign Application Priority Data

Jul. 10, 1997 (DE) ..... 197 29 548
Aug. 29, 1997 (DE) ..... 197 37 858

(51) Int. Cl.[7] ..... B06P 1/00

(52) U.S. Cl. ..... 250/223 R; 250/559.27; 414/346

(58) Field of Search ..... 250/223 R, 559.22, 250/559.27; 209/172.5; 414/346, 376, 397, 574

(56) References Cited

U.S. PATENT DOCUMENTS

| | | | | |
|---|---|---|---|---|
| 3,601,244 A | * | 8/1971 | Ort et al. | 198/36 |
| 3,727,332 A | | 4/1973 | Zimmer | |
| 3,813,171 A | | 5/1974 | Teach et al. | |
| 4,507,910 A | | 4/1985 | Thornley et al. | |
| 6,238,162 B1 | * | 5/2001 | Mayer et al. | 414/346 |

FOREIGN PATENT DOCUMENTS

| | | |
|---|---|---|
| EP | 0 412 399 | 2/1991 |
| EP | 0 412 402 | 2/1991 |

* cited by examiner

*Primary Examiner*—Stephone Allen
(74) *Attorney, Agent, or Firm*—BakerBotts LLP

(57) ABSTRACT

A conveyor is described which includes, for example, a bucket wheel arranged on a jib for reducing especially compressed stockpiles or, respectively, for piling up bulk goods, conveyor is constructed so as to pick up or pile up piled-up bulk goods. The conveyor includes a measuring device for measuring the surface profile of the stockpile device. The conveyor is associated with a control device which is constructed so as to move the conveyor automatically to the desired removal or, respectively, piling-up position in dependence on the measured stockpile surface.

17 Claims, 6 Drawing Sheets

CONVEYOR DEVICE

FIELD OF THE INVENTION

The present invention relates to a conveyor device including, for example, a bucket wheel arranged on a jib for reducing, for example compressed stockpiles or for piling up bulk goods. The conveyor device is constructed so as to pick up or pile up piled-up bulk goods. The conveyor device includes a measuring device for measuring the surface profile of the stockpile.

BACKGROUND INFORMATION

Storage and transport systems optimized with respect to stock and processing time are an important component of modern flexible bulk goods handling plants. Obsolescence-proof solutions take into consideration to a particular extent the inclusion in the automation hierarchy and the inexpensive and simple handling in later operation. An object of the present invention is to specify a bulk goods handling device such as, for example, a bucket wheel device or a gantry drag or similar which allows for more inexpensive and simple handling.

SUMMARY

In accordance with the present invention, a conveyor device, for example, a bucket wheel device is provided for reducing especially compressed stock piles or for piling up bulk goods is associated with a control device. The bucket wheel device picking up piled-up bulk goods or, respectively, piling up bulk goods. The bucket wheel device includes a measuring device for measuring the surface profile of the stockpile. The control device automatically moves the bucket wheel device up to the pile-reducing or, respectively, piling-up position based on on the measured stockpile surface. In this arrangement, the bulk goods are automatically removed from the pile or, respectively, piled up by means of the bucket wheel device. This makes it possible to reduce the number of operating personnel needed to operate bucket wheel devices. Since bucket wheel devices generally run in 3-shift operation, this leads to a distinct cost advantage.

Moving the bucket wheel device up to a desired pile-reducing or piling-up position is a particularly maneuver since a collision of the bucket wheel with the stockpile can easily lead to damage or even destruction of the bucket wheel device. This particularly applies to stockpiles which are compressed during the depositing or thereafter so that the material does not ignite itself. Generally, the compression is performed by wheel loaders. In this process, the stockpile profile is greatly changed. Other reasons for a change in the stockpile profile can be stockpile downfalls or weather influences, e.g., severe rain and resulting slipping-down of a stockpile side. The problem of precise positioning of the bucket wheel in the case of stockpiles having an irregular profile caused by such influences is solved particularly advantageously by a control which calculates the surface profile of the stockpile from the measurement values supplied by the measuring device.

In a particularly advantageous embodiment of the present invention, the measuring device is arranged at the jib, especially in the front area of the jib. Because it is arranged in the front area of the jib, the measuring device supplies particularly complete measurement values in the area scanned by it.

In an advantageous embodiment of the present invention, the measuring device includes a laser, for example, a semi-conductor laser by means of which the stockpile surface is scanned. Scanning of the stockpile surface is advantageously performed by means of a rotating mirror which is arranged within the range of the beam of the laser in such a manner that the laser beam scans the stockpile surface.

In a further advantageous embodiment of the present invention, the bucket wheel device is associated with a video camera which is constructed so as to pick up the pile-reducing or, respectively, piling up of the bulk goods. This video camera is advantageously arranged behind the bucket wheel.

In a further advantageous embodiment of the present invention, the bucket wheel device is also associated with a control system or a control centre with a display device by means of which the stockpile profile and/or the pile-reducing or piling-up process can be advantageously displayed.

DETAILED DESCRIPTION

Figure 1:
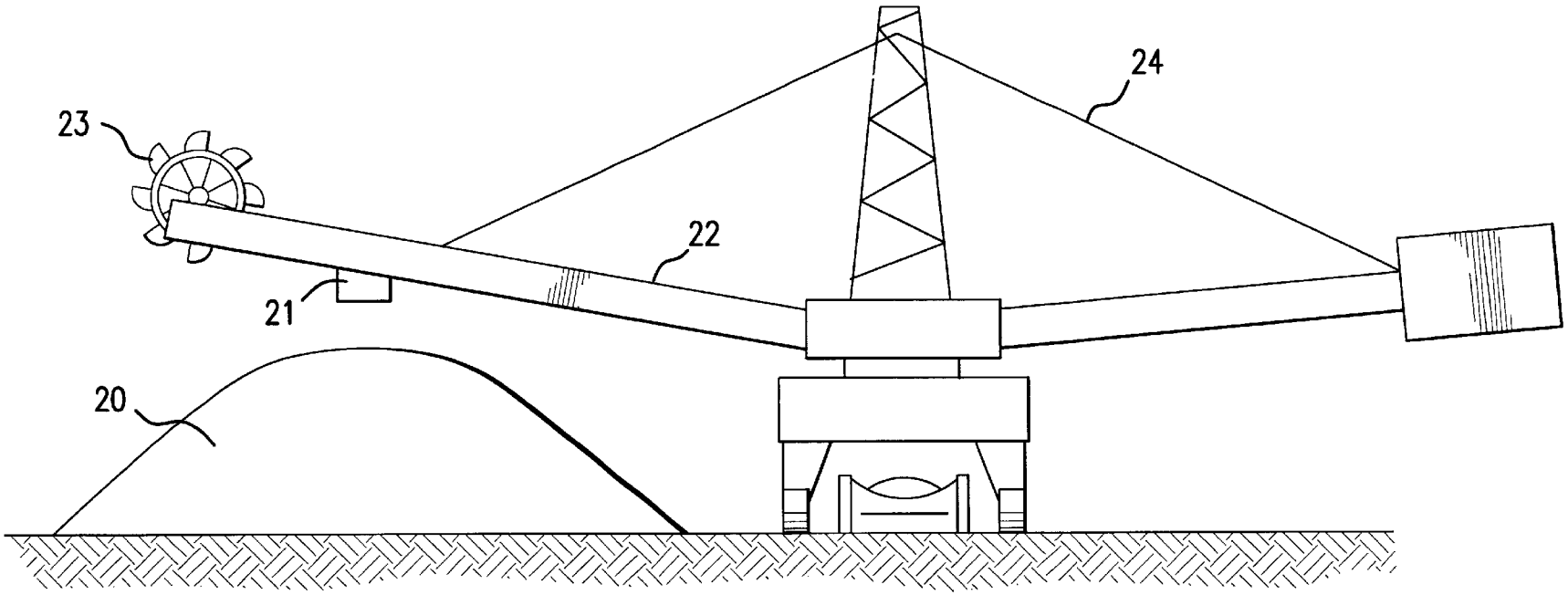
FIG. 1 shows a bucket wheel device according to the present invention.

FIG. 1 shows a bucket wheel device 24 according to the present invention. The bucket wheel device 24 includes a bucket wheel 23 arranged on a jib 22. The bucket wheel 23 is used for removing bulk material from a stockpile or, respectively, piling up bulk material on a stockpile 20. The bucket wheel device according to the present invention automatically moves to a pile-reducing or piling-up position and automatically removes the bulk material or, respectively, automatically piles it up. The bucket wheel 23 is driven to the desired position as a function of a surface profile of the stockpile. This is calculated by a control device, not shown, as a function of measurement values from a measuring device 21. The measuring device 21 is advantageously arranged in the front area of the jib 22. The measuring device 21 is used for scanning the stockpile surface. From these samples, a control device, not shown in FIG. 1, calculates the surface profile of the stockpile 20. In an illustrative embodiment of the present invention, the bucket wheel device 24 is moved, during a measuring run, along the stockpile in such a manner that the measuring device 21 scans the entire stockpile. In an alternative and advantageous development, no separate measuring runs are made with the bucket wheel device 24 but the surface profile is calculated from measurement data which are determined during the normal operation of the bucket wheel device.

Figure 2:
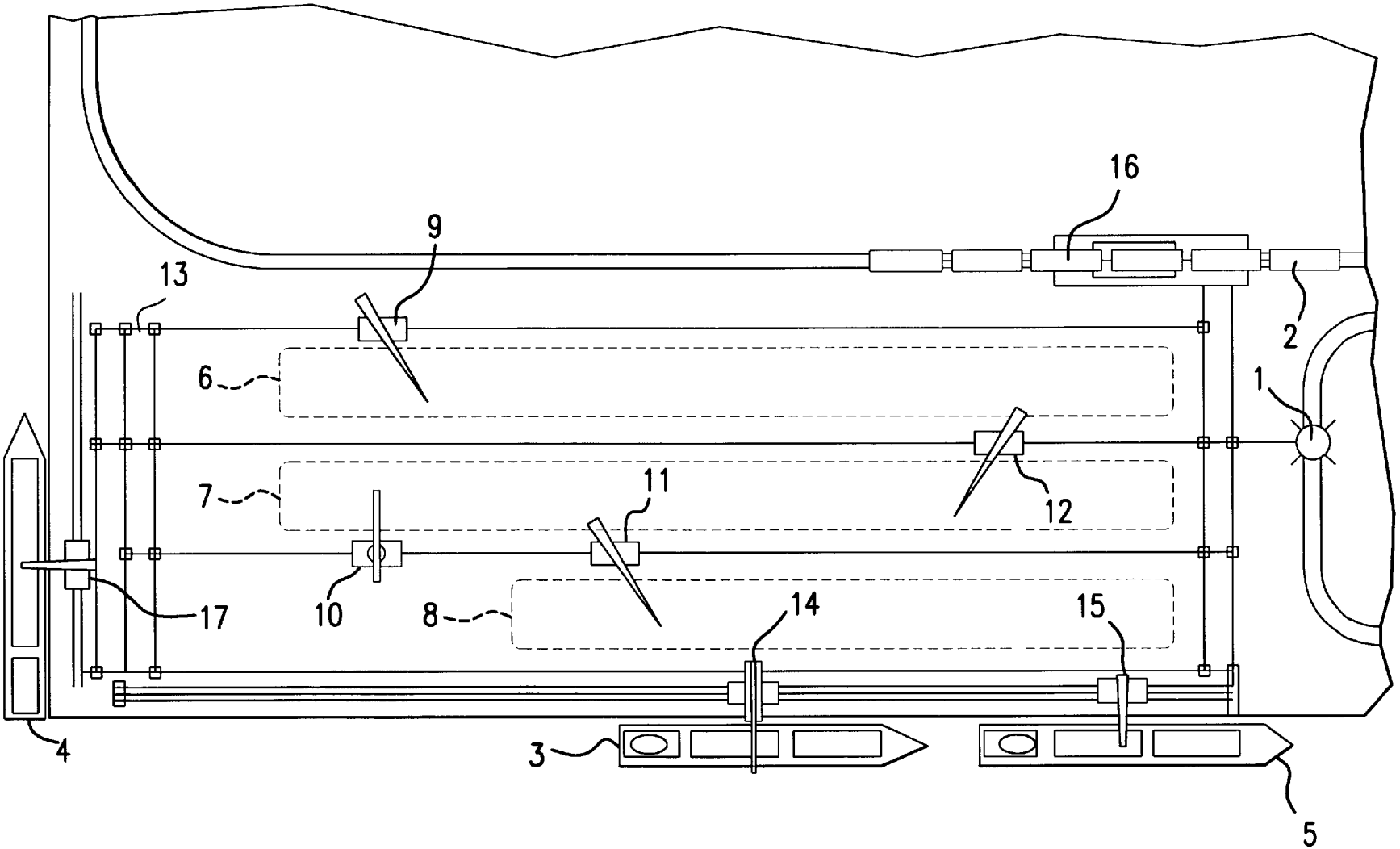
FIG. 2 shows a bulk goods handling station.

FIG. 2 shows a handling station for bulk goods for which the bucket wheel device according to the present invention is used in a particularly advantageous manner. The illustrative bulk goods handling station is used for transferring bulk goods between the transporters, ship 3, 4, 5, train 2 and lorry. For this purpose, the bulk goods handling station includes ship loading and unloading devices 14, 15, 17, a lorry loading and unloading device 1 and a train loading and unloading device 16. These are connected to one another via a conveyor belt system 13. Stockpiles 6, 7, 8 are provided for temporary storage of the bulk goods. The piling up of the bulk goods on the stockpiles or, respectively, the removal of the bulk goods from the stockpiles is performed by bucket wheel devices 9, 10, 11 and 12 according to the present invention. The bucket wheel devices are also connected to the conveyor belt system 13.

Figure 3:
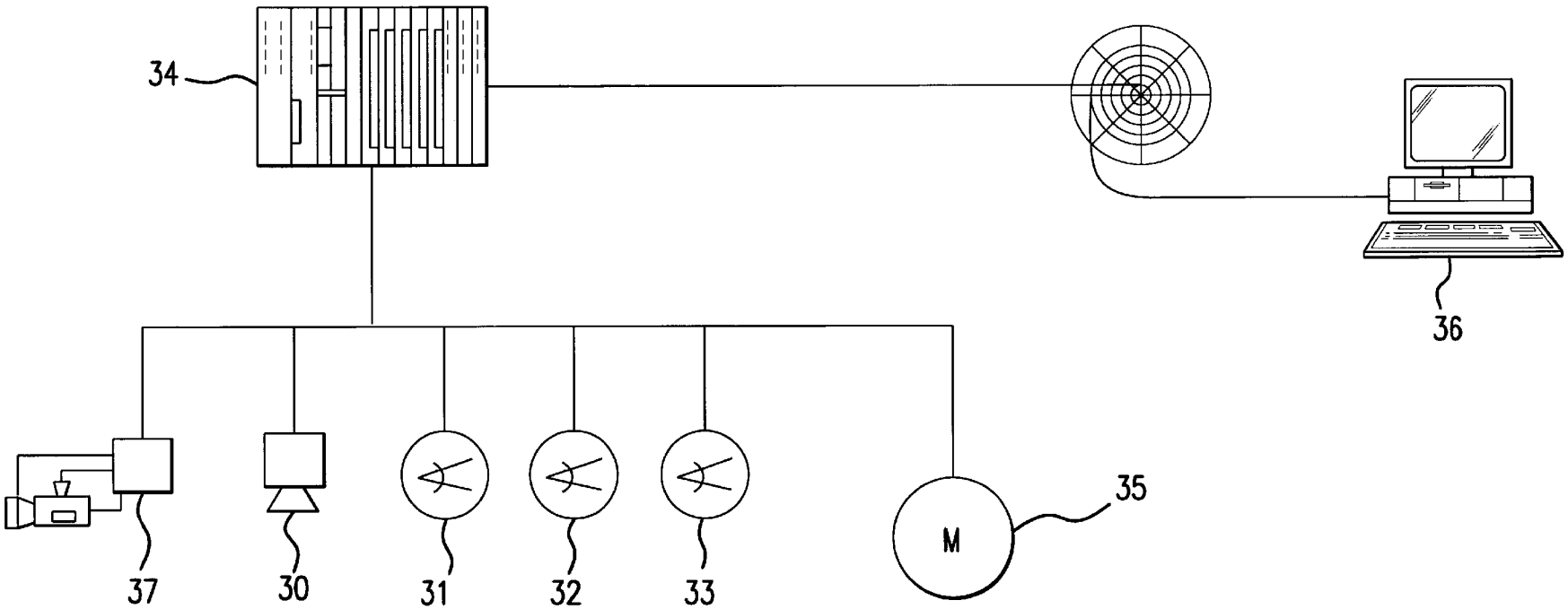
FIG. 3 shows a hardware configuration for a bucket wheel device, according to the present invention.

FIG. 3 shows a hardware configuration for a bucket wheel device according to the present invention. Drive systems 35 for travelling mechanism, lifting mechanism and rotating mechanism are provided for positioning the bucket wheel device. The drive system 35 is controlled by a control device 34 as a function of the measurement values of angle transmitters 31, 32 and 33. The set points for the control are also calculated in the control 34. For this purpose, the control 34 determines the surface profile of the stockpile from which bulk goods are to be removed or, respectively, on which bulk goods are to be piled up, as a function of measurement values which are supplied by a measuring device 30. This measuring device 30 is advantageously constructed as a semiconductor laser comprising a rotating mirror. The data from the control 34 are connected to a higher-level control system 36. The higher-level control system 36 is advantageously connected to the controls of a number of bucket wheel devices according to the present invention.

Figure 4:
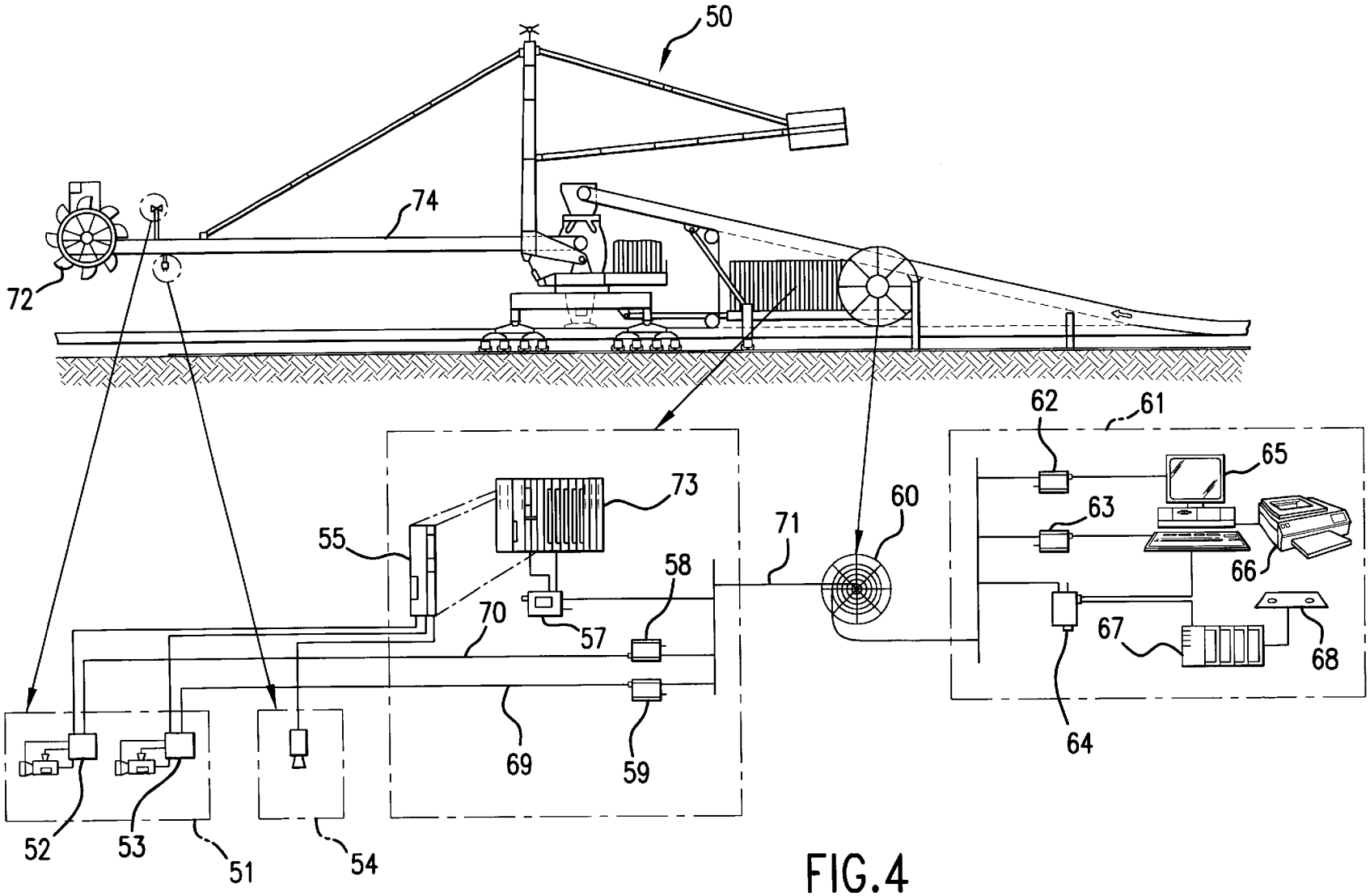
FIG. 4 shows a detailed representation of an example hardware configuration for a bucket wheel device according to the present invention.

FIG. 4 shows a detailed representation of an illustrative hardware configuration for a bucket wheel device 50 according to the present invention. The bucket wheel device 50 exhibits a jib 74, at the end of which a bucket wheel 72 is arranged. Behind the bucket wheel 72, an arrangement 51 including video cameras 52 and 53 and a measuring device 54 are arranged. The video cameras 52, 53 are connected via video communication links 69, 70 and optical waveguide converters 58, 59 to an optical waveguide 71. In addition, the data from the video cameras 52, 53 and the measuring device 54 are connected to a control device 73. The control device 73 includes a plug-in PC 55. The plug-in PC 55 is used in the control 73 for calculating the surface profile of the stockpile, from which bulk goods are to be removed or, respectively, on to which bulk goods are to be piled up, in dependence on measurement values which are supplied by the measuring device 54. The bucket wheel device 50 is controlled in dependence on this surface profile. The control device 73 is connected to the optical waveguide 71 via an optical interface 57. The optical waveguide 71 is conducted to a control centre 61 via a cable drum 60. The control center 61 includes a display device 65 and a control panel 68 which is connected to the optical waveguide 71 via a peripheral device 67 and an optical interface 64. The display device 65 is connected to the optical waveguide 71 via optical waveguide converters 62, 63. The control center 61 advantageously includes a printer 66. The communications link implemented on the optical waveguide 71 is constructed, for example, as a bus system. In conjunction with the optical waveguide 71, this produces a particularly fast and reliable communications link between the control 73 which is constructed especially advantageously as a stored-program control, and the control center 61.

In the control device 73, the following tasks are performed calculating a 3-D; converter of the stockpile profile from the data of the measuring device 54 and angle transmitters 31, 32, 33 on travelling, rotating and lifting mechanism;

smoothing the calculated 3-D model;

controlling cameras 52, 53 when cutting into the stockpile (for optical safety monitoring at the control centre). Additionally, in the control system, the tasks of:

representing the stockpile in 2D or 3D calculating the precise starting point on input of a job order and task management and displaying of the camera pictures in real time are implemented.

The following illustrative embodiment explains the operation of the bucket wheel device according to the present invention. An empty stockpile is assumed. The example material to be stored is bituminous coal. The example performance data of the bucket wheel device in the illustrative embodiment includes the following:

Depositing capacity 2000 t/h

Removing capacity 1600 t/h

Jib length 40 m

Angle of rotation 100°

Lifting mechanism +10°, −8°

Typical stockpile height 6 . . . 10 m, trapezoidal cross-section

Typical stockpile width 35 m

Typical stockpile length 400 m

By way of example, the following operating steps are carried out:

Input of a depositing job via a control centre PC: start 0 m, End 70 m.

Start command is transferred from the control centre PC to the control of the bucket wheel device.

The bucket wheel device moves to the start position and issues a conveying release to a belt system for transporting to the bucket wheel device bituminous coal which is to be piled up by the bucket wheel excavator.

In accordance with the incoming quantity of bituminous coal, the rotating speed is controlled by the control and the is bituminous coal automatically deposited in the predetermined area.

The control continuously polls the values of the angle transmitters (compare measuring devices 31, 32, 33, FIG. 3) and band weigher measurement values. From these, a provisional stockpile model is calculated in the control.

After completion of the depositing process, bituminous coal is compressed by wheel loaders.

Input of a measuring run between 0 m and 70 m for determining the precise stockpile model.

The jib is rotated over the stockpile and the area is covered at maximum speed of the travelling mechanism (up to 40 m/min).

During the measuring run, the laser attached to the jib scans the stockpile at 3 measuring pulses per 10 cm distance travelled, each measuring pulse leading to 200 measurement values.

Blanking out invalid values, recalculation into vectors, interpolation of missing values and smoothing of the profile obtained by the control.

Continual updating of the stockpile model in the control centre PC.

When the 70 m mark is reached, end of the measuring run and message at the control centre.

Input of a removal job by the operator by positioning a ruler with the mouse in a 3-D graphic of the stockpile displayed on the control centre PC and inputting of the required quantity, e.g., cutting in at 65 m, quantity= 5000 t.

Calculating the precise point of cutting in and sending a removal order with start co-ordinates by the control centre PC to the control.

Bucket wheel device moves into position, the camera pictures are displayed in real time on the control centre PC.

Message to the operator: "Cutting-in position reached, continue?"

After release by the operator of the control centre PC by clicking the mouse, the bucket wheel device automatically processes the removal job. During this process, the stockpile profile is tracked on the basis of the respective bucket wheel position. Conversely, the control in each case receives the turn-over points for the rotating mechanism in dependence on cutting height and stockpile profile.

The quantity measurement derived by the belt weigher reaches the value of 5000 t; the control lifts the rotating mechanism and sets it parallel to the travelling rail.

Message to the operator of the status PC: "Job 65 m, 5000 t ended".

Figure 5:
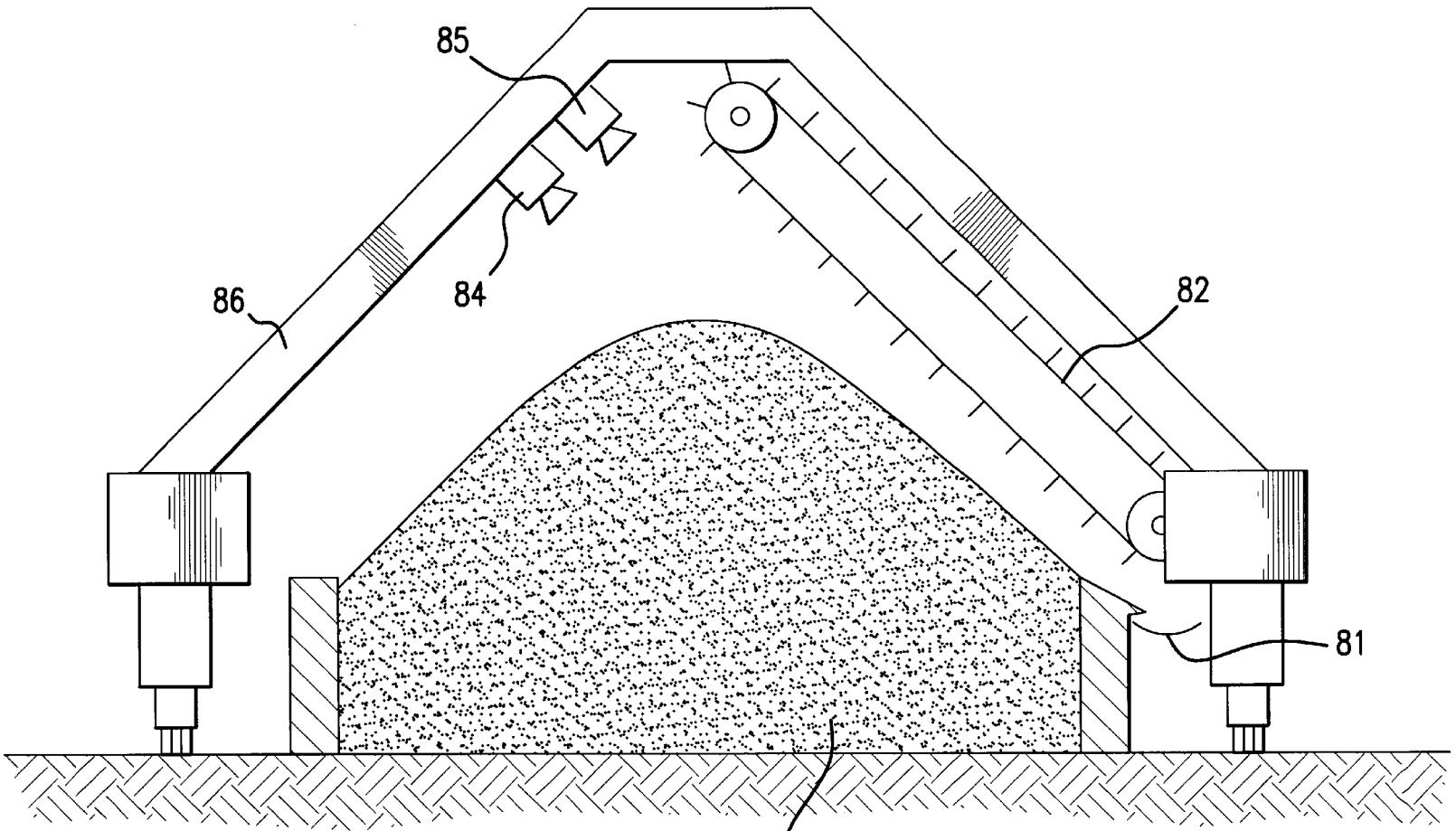
FIG. 5 shows a gantry drag according to the present invention.

FIG. 5 shows a gantry drag 82 constructed in accordance with the present invention for piling up bulk goods on a stockpile 80 or, respectively, for removing bulk goods from the stockpile 80. During the removal from the stockpile 80, the gantry drag 82 moves bulk goods from the stockpile 80 to a conveyor belt 81. The gantry drag 82 is controlled analogously to the description with respect to FIGS. 1 to 4 in dependence on a 3-dimensional model of the stockpile 80. This is determined by means of a measuring device 84 which is arranged movably on the cover 86 of the stockpile 80. Furthermore, a monitoring camera 85 is arranged on the cover 86.

Figure 6:
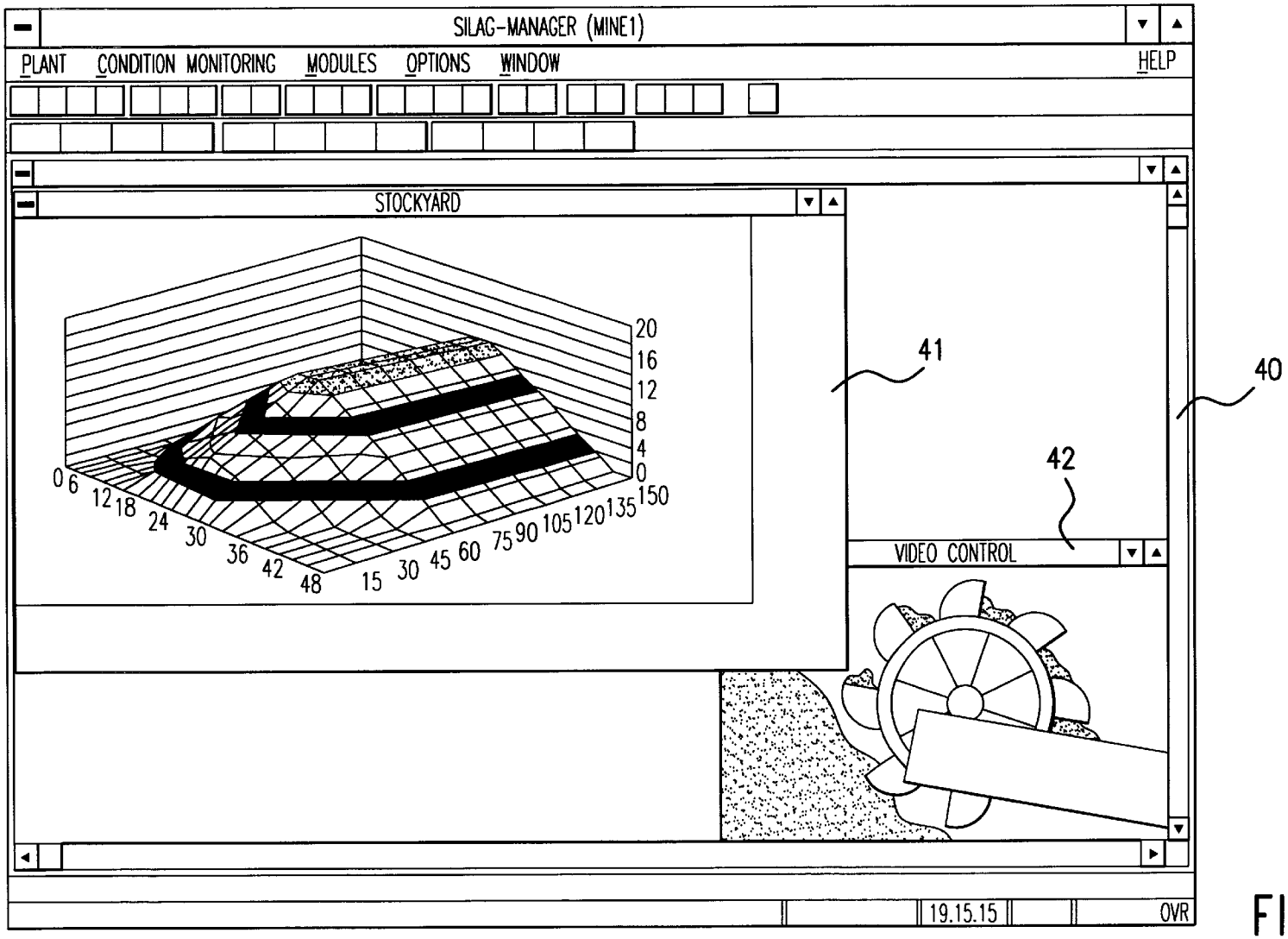
FIG. 6 shows a screen area for a display system for a bucket wheel excavator according to the present invention.

The control system 36 in FIG. 4 advantageously exhibits a display system such as it is shown, for example, in FIG. 6. This display system advantageously exhibits at least one screen for representing information in a so-called window technique. According to this type of representation, various detail windows 41 and 42 can be shown in a main window 40. In the illustrative representation according to FIG. 6, a window 41 with a 3-D image of the surface profile of the stockpile and a window 42 with a video image of the bucket wheel device reducing the stockpile shown in window 41 are shown.

What is claimed is:

1. A conveyor device, comprising:

an arrangement for at least one of picking up piled-up bulk goods from a stockpile and piling-up the bulk goods on the stockpile;

a measuring device measuring a surface profile of the stockpile; and a control device controlling the arrangement to automatically move up to one of a desired removal position and a desired stockpiling position as a function of the measured stockpile surface profile.

2. The conveyor device according to claim 1, wherein the control device further controls the arrangement to one of automatically remove the piled-up bulk goods, and automatically pile-up the bulk goods.

3. The conveyor device according to claim 1, wherein the arrangement includes a jib, the measuring device being arranged on a front area of the jib.

4. The conveyor device according to claim 1, wherein the measuring device includes an optical measuring device.

5. The conveyor device according to claim 4, wherein the optical measuring device includes a laser.

6. The conveyor device according to claim 5, wherein the laser includes a semiconductor laser.

7. The conveyor device according to claim 5, wherein the laser includes a rotating mirror.

8. The conveyor device according to claim 1, wherein the control device evaluates the measured surface as a function of measured values supplied to the control device from the measuring device, and determines from the measured values the stockpile surface profile.

9. The conveyor device according to claim 1, further comprising:

at least one video camera capturing images of the one of the picking up of the bulk goods and piling-up of the bulk goods.

10. The conveyor device according to claim 9, wherein the arrangement includes a bucket wheel, the at least one video camera being arranged behind the bucket wheel.

11. The conveyor device according to claim 1, wherein the conveyor device is associated with a control center, the control center including a display device displaying at least one of: i) an image of the stockpile surface profile, ii) images of the picking up of the bulk goods, and iii) images of the piling-up of the bulk goods.

12. The conveyor device according to claim 11, further comprising:

an optical waveguide acting as a communications link between the control device and the control center.

13. The conveyor device according to claim 11, further comprising:

at least one video camera capturing images of the one of the picking up of the bulk goods and piling-up of the bulk goods; and an optical waveguide acting as a communications link between the at least one video camera and the control center.

14. The conveyor device according to claim 12, wherein the communications link is a bi-directional communications link.

15. The conveyor device according to claim 14, wherein the communications link is a bus system.

16. The conveyor device according to claim 1, wherein the arrangement includes a bucket wheel device, the bucket wheel device including a bucket wheel arranged on a jib.

17. The conveyor device according to claim 1, wherein the arrangement includes a gantry drag.

* * * * *